US010557268B2

(12) United States Patent
Presley

(10) Patent No.: US 10,557,268 B2
(45) Date of Patent: Feb. 11, 2020

(54) SEALING APPARATUS FOR CORRUGATED ROOFING AND SIDING AND METHODS THEREOF

(71) Applicant: Timothy Scott Presley, Skandia, MI (US)

(72) Inventor: Timothy Scott Presley, Skandia, MI (US)

( * ) Notice: Subject to any disclaimer, the term of this patent is extended or adjusted under 35 U.S.C. 154(b) by 0 days.

(21) Appl. No.: 16/140,502

(22) Filed: Sep. 24, 2018

(65) Prior Publication Data

US 2019/0093364 A1 Mar. 28, 2019

Related U.S. Application Data

(60) Provisional application No. 62/562,402, filed on Sep. 23, 2017.

(51) Int. Cl.
*E04D 3/38* (2006.01)
*E04D 13/147* (2006.01)
*E04D 3/30* (2006.01)

(52) U.S. Cl.
CPC ..... *E04D 3/38* (2013.01); *E04D 13/1475* (2013.01); *E04D 13/1476* (2013.01); *E04D 3/30* (2013.01)

(58) Field of Classification Search
CPC .. E04D 3/30; E04D 3/38; E04D 13/14; E04D 13/1475; E04D 13/1476; E04F 17/02
USPC ..... 52/219, 220.4, 220.8
See application file for complete search history.

(56) References Cited

U.S. PATENT DOCUMENTS 3,135,070 A * 6/1964 Waring ..... E04B 7/20 52/94
3,828,494 A * 8/1974 Uhrhane ..... E04D 13/1475 52/15
2004/0255523 A1* 12/2004 Bibaud ..... E04D 13/1476 52/58
2012/0073239 A1* 3/2012 Haines ..... E04D 13/1475 52/745.21
2015/0121773 A1* 5/2015 Mills ..... E04D 13/1475 52/58
2018/0312331 A1* 11/2018 Forrest ..... B65D 88/741

FOREIGN PATENT DOCUMENTS

EP 0320406 A1 * 6/1989 ..... E04D 13/0305
FR 2998317 A1 * 5/2014 ..... E04D 13/0315

* cited by examiner

*Primary Examiner* — Christine T Cajilig
(74) *Attorney, Agent, or Firm* — Device Patent LLC

(57) ABSTRACT

Disclosed are sealing apparatuses used in conjunction with corrugated roofing around chimneys, vents, solar tubes, and other structures protruding through corrugated roof or siding. In one embodiment a specialized gasket comprising gasket ribs having a profile that matches a chosen corrugated sheet metal barrier is utilized. A transition barrier hole is cut into the corrugated sheet metal barrier and then the hole is used to cut a transition gasket hole in the gasket. A sealant is used between the gasket and mating parts to create a seal about the transition vessel to prevent roof leaks. In some embodiments, the gasket is in the form of gasket plugs which may be trimmed and utilized to plug and seal the corrugations surrounding a transition barrier hole in a corrugated sheet metal barrier.

16 Claims, 14 Drawing Sheets

SEALING APPARATUS FOR CORRUGATED ROOFING AND SIDING AND METHODS THEREOF

This application claims priority to Provisional Patent Application No. 62/562,402 filed Sep. 23, 2017, the entire disclosure of which is hereby incorporated by reference and relied upon.

BACKGROUND OF THE INVENTION

Field of the Invention

The invention relates generally to sealing apparatuses, and more particularly to sealing apparatuses used in conjunction with corrugated roofing particularly around chimneys, vents, solar tubes, and other structures protruding through a corrugated roof and their methods of use.

Description of Related Art

The prior art has unsuccessfully attempted to develop methods to seal around structures extending through corrugated roofs such as chimneys, vent pipes, and solar tubes. A majority of this art attempts to create a seal by placing a sealing structure over a superior surface of corrugated roofing. These approaches frequently leak. What is needed are dependable solutions for sealing between corrugated roofs and transitional vessels extending through or abutting a corrugated roof.

SUMMARY OF THE INVENTION

The article of invention is an apparatus used create a seal between one or more of corrugated roofing and siding, and a structure protruding through or adjacent to the one or more of corrugated roofing and siding to prevent leakage.

In one form, a generally vertical corrugated wall comprises a corrugated sheet metal barrier.

In one form, a corrugated roof comprises a corrugated sheet metal barrier.

In one form, a corrugated sheet metal barrier may be alternatively manufactured from a composite material and used as a corrugated barrier.

In one form, a corrugated sheet metal barrier comprises an anti-corrosive layer. The anti-corrosive layer may be in the form of one or more of; a galvanized steel, a zinc coating, a polymer coating, and a paint coating.

In one form, a corrugated sheet metal barrier is shaped with spaced generally linear elongate ribs.

In one form, a corrugated sheet metal barrier comprises a superior peak and an inferior peak at each elongate rib defining a corrugated thickness 'C'.

In one form, a corrugated sheet metal barrier comprises a transition wall between the superior peak and inferior peak.

In one form, a corrugated sheet metal barrier comprises an inner surface facing a roofing truss structure and an outer surface facing the sky.

In one form, each generally linear elongate rib of a corrugated sheet metal barrier has a generally trapezoid profile.

In one form, the corrugated sheet metal barrier comprises an end profile that is generally sinusoidal.

In one form, a corrugated sheet metal barrier is coupled to one or more of a roofing truss and rafter structure.

In one form, a corrugated sheet metal barrier is coupled to one or more generally horizontally positioned purlins of a roofing truss structure.

In one form, an underlayment is positioned between a corrugated sheet metal barrier and a roofing truss structure.

In one form, roof sheathing (i.e. plywood, OSB) is positioned between a corrugated sheet metal barrier and a roofing truss structure.

In one form, insulation is positioned between a corrugated sheet metal barrier and a roofing truss structure.

In one form, one or more of; underlayment, roof sheathing, and insulation are sandwiched between a corrugated sheet metal barrier and a roofing truss structure.

In one form, roofing fasteners such as one or more of; screws, nails, and staples are used to secure a corrugated sheet metal barrier to purlins and/or other portions of a roofing truss structure.

In one form, a transition vessel extends above an outer surface and below an inner surface of a corrugated sheet metal barrier.

In one form, a transition barrier hole is created within a corrugated sheet metal barrier to provide passage of a transition vessel therethrough.

In one form, a transition vessel is in the form of one or more of; a chimney, a vent pipe, and a solar tube.

In one form, a sealing member is used between a transition vessel and corrugated sheet metal barrier to prevent leakage therebetween.

In one form, a sealing member is used between a corrugated sheet metal barrier and a truss structure to prevent leakage therebetween.

In one form, a sealing member is in the form of a gasket.

In one form, the gasket comprises an upper surface wherein said upper surface comprises a profile generally complementing an inside (facing) surface of a corrugated sheet metal barrier.

In one form, the upper surface comprises gasket ribs which are shaped and sized to complement elongate ribs formed in an inside facing surface of a corrugated sheet metal barrier.

In one form, a gasket comprises a lower surface.

In one form, the lower surface of the gasket is generally flat.

In one form, the gasket comprises a height thickness 'H' extending between a superior most part of it's upper surface and most inferior most part of its lower surface.

In one form, the gasket comprises a perimeter surface extending between adjacent portions of said upper surface and said lower surface.

In one form, the minimal height of said gasket perimeter surface is material thickness 'M'.

In one form, a perimeter surface defines a gasket foot print that is larger than the cross sectional size of a corresponding transition vessel.

In one form, a transition gasket hole is positioned inward a gasket perimeter surface and extends between said upper surface and lower surface of said gasket.

In one form, gasket ribs on a gasket are aligned with elongate ribs on a corrugated sheet metal barrier and a transition gasket hole is cut by a user through said gasket wherein said transition gasket hole and transition barrier hole on the corrugated sheet metal barrier are generally aligned for passage of a transition vessel therethrough.

In one form, a transition gasket hole is defined by a transition gasket hole surface.

In one form, a transition gasket hole comprises a size and profile for passage of a corresponding transition vessel.

In one form, a transition gasket hole is sized to provide a stretch fit about a transition vessel.

In one form, a transition gasket hole used on a roof having a pitch is formed at an angle 'P' through height thickness 'H' to provide passage of a generally vertical transition vessel.

In one form, an upper surface distance between a perimeter surface and transition gasket hole surface of a gasket is sufficient to provide a seal against fluid leakage between the gasket and corrugated sheet metal barrier.

In one form, one or more gasket supports are fixed to a portion of a roofing truss system. A support surface on the gasket support abuts a lower surface of said gasket thereby maintaining the gasket pressed against an inner surface of a corrugated sheet metal barrier.

In one form, one or more gasket supports are fixed to a portion of a roofing truss system. A support surface on the gasket support is embedded in a lower surface of said gasket thereby maintaining the gasket pressed against an inner surface of a corrugated sheet metal barrier.

In one form, one or more embedding holes perforate a support surface of a gasket support.

In one form, one or more gasket supports comprise a stiffness flange extending from the support surface to provide stiffness to a gasket support.

In one form, one or more gasket supports comprise fixation flanges at one or more ends of the one or more gasket supports.

In one from, the one or more fixation flanges comprises a fixation hole for housing a fastener such as a nail, or screw for fixation of a gasket support to a truss or rafter structure.

In one form, a gasket support is elongate having a length for fitting between a pair of spaced purlins and with each fixation flange adjacent a side purlin wall.

In one form, a plurality of gasket supports fixedly extending between a pair of opposed purlins support a gasket against an inner surface of a corrugated sheet metal barrier.

In one form, a secondary gasket support extends between a pair of spaced gasket supports.

In one form, a gasket support is in the form of a metal rod.

In one form, a gasket support is in the form of a wood plank.

In one form, a gasket support is adjustable in length.

In one form, a gasket comprises a portion of one or more pieces of vessel flashing embedded in a transition gasket hole surface of the gasket.

In one form, a vessel flashing comprises a vessel portion generally aligned with an outer face of a transition vessel, and a gasket portion generally aligned with a gasket plane 'G'.

In one form, a vessel flashing comprises a flashing bend between the vessel portion and the gasket portion.

In one form, a vessel flashing comprises an elongate break notch at an inferior end of the vessel portion of a vessel flashing for breaking a vessel portion from a gasket portion of the vessel flashing.

In one form, the vessel portion of a vessel flashing is generally vertical.

In one form, an angle 'A' between a horizontal and a gasket portion is generally the same as the slope of the corresponding roof.

In one form, a vessel portion of a vessel flashing is trimmed such that the width of the vessel portion is generally the width of a corresponding transition vessel and the trimmed portion is then broken away at a break notch.

In one form, a vessel portion of a vessel flashing extends upward from a low end of a perimeter surface of a gasket.

In one form, a vessel portion of a vessel flashing abuts a wall of a building at a low end of a roofing truss structure.

In one form, a gasket portion of a vessel flashing is embedded in and across a low end of a perimeter surface of a gasket.

In one form, a gasket comprises a generally linear flash channel extending from a first side of a perimeter surface to a second side of the perimeter surface wherein said generally linear channel is sized and shaped to seat a gasket portion of a vessel flashing.

In one form, a viscous sealant is applied within the generally linear flash channel for sealed seating of a vessel flashing.

In one form, a vessel flashing is trimmed in length to complement a corresponding transition vessel and inserted in said flash channel in a predetermined position aligned with the transition vessel.

In one form, a flash channel is formed in a low end of a perimeter surface of a gasket to seat a gasket portion of a vessel flashing.

In one form, a gasket portion of a vessel flashing is mold embedded in a low end of a perimeter surface of a gasket.

In one form, a ribbed gasket is positioned between an inner surface of a corrugated sheet metal barrier and a superior surface of a vent boot and supported by one or more gasket supports.

In one form, seams encircling a sealing apparatus within a corrugated roof assembly are sealed with caulk or other sealant.

In one form, a sealing apparatus for corrugated roofing comprises various length stocks of a gasket plug.

In one form, various length stocks of a gasket plug comprise one or more of a first length stock, a second length stock, a third length stock, and a fourth length stock.

In one form, a gasket plug comprises an elongate profile matching a corrugation profile of a corresponding corrugated sheet metal barrier.

In one form, a gasket plug is polymeric.

In one form, a gasket plug is of an extended length and is cut into a plurality of shorter lengths by a user as required for a particular application.

In one form, a gasket plug comprises a metal facing surface and an opposed ground facing surface wherein the metal facing surface complements a corresponding corrugated metal roofing profile and the ground facing surface is generally planar.

In one form, the ground facing surface of a gasket plug is positioned against a roof sheathing.

In one form, the ground facing surface of a gasket plug is positioned against an underlay membrane such as felt saturated with asphalt or a synthetic fabric.

In one form, the ground facing surface of a gasket plug is positioned against flashing.

In one form, the ground facing surface of a gasket plug is positioned against an upward facing surface of a vent boot.

In one form, at least a portion of one or more of a metal facing surface and an opposed ground facing surface is covered with sealant before positioned between a corrugated sheet metal barrier and an inferiorly supporting surface such one of: an upward facing surface of a vent boot, an underlay membrane, flashing, roof sheathing, and roofing underlayment.

In one form, a gasket plug comprises a trimmed portion to provide clearance for structures extending through a corrugated sheet metal barrier.

In one form, a gasket plug is trimmed on an end to provide clearance for structures extending through a corrugated sheet metal barrier.

In one form, a gasket plug is trimmed on a side to provide clearance for structures extending through a corrugated sheet metal barrier.

In one form, a support plate is utilized to provide inferiorly placed support in the absence of roofing sheathing.

In one form, the support plate is plywood.

In one form, the support plate comprises a support plate aperture for passage of structures such as a vent or chimney extending through an inferior face and superior face of the support plate.

In one form, the support plate is fixed in position by one or more gasket supports.

In one form, a preferred embodiment of a method for sealing a transition vessel extending through one or more of a corrugated roof and siding comprises the following steps. A designated roof or wall is framed including creating a fully supported opening of a size sufficient for passage of a transition vessel through the plane of the corresponding wall or roof. Install a transition vessel (i.e. such as a chimney, plumbing vent, electrical, etc.) and secure the transition vessel in place per common practices or manufacturers standards. Install a flashing having a flat sealable flange to the transition vessel. Begin installation of the corresponding corrugated sheet metal barrier (i.e. roofing, siding) at a convenient starting point. When the corrugated sheet metal is advanced to the point of encountering a transition vessel (or other protuberance), the position, shape, and size of a transition barrier hole is determined. A predetermined transition barrier hole is then cut through the corresponding corrugated sheet metal barrier. The corrugated sheet metal barrier is positioned on the corresponding roof or wall with the transition vessel extending therethrough to validate proper transition barrier hole position. The corrugated sheet metal barrier with transition barrier hole is removed and a ribbed gasket is joined generally centered over the newly cut transition barrier hole. Gasket ribs are positioned to align and occupy ribs on the corrugation profile on the back side of the corrugated sheet metal barrier. Using the outline of the transition barrier hole in the corrugated sheet metal barrier as a template, a transition gasket hole is cut in the corresponding gasket. Any undesired excess material is then cut from the periphery of the gasket. Sealant is then applied to a top side of corresponding flashing. The prepared gasket is placed over the transition vessel with the generally flat side facing the flange seated down upon the bed of sealant on the flashing. A bed of sealant is then applied to the upper surface and gasket ribs of the prepared gasket preferably around the entire periphery of the transition gasket hole to prevent water seepage. The prepared corrugated sheet metal barrier is then placed over the top of the gasket with gasket ribs aligned with the corrugations of the metal. The prepared corrugated sheet metal barrier is then secured according to manufacturer's recommendations.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF SELECTED EMBODIMENTS OF THE INVENTION

Select embodiments of the invention will now be described with reference to the Figures. To prevent unnecessary labeling of like elements, like numerals indicate like or corresponding elements throughout the several views and wherein various embodiments are distinguished by letters (i.e. 100A, 100B, 100C). The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

The article of invention is an apparatus used to create a seal between a corrugated roof and a structure protruding through or adjacent to the corrugated roof to prevent leakage therebetween.

Figure 1:
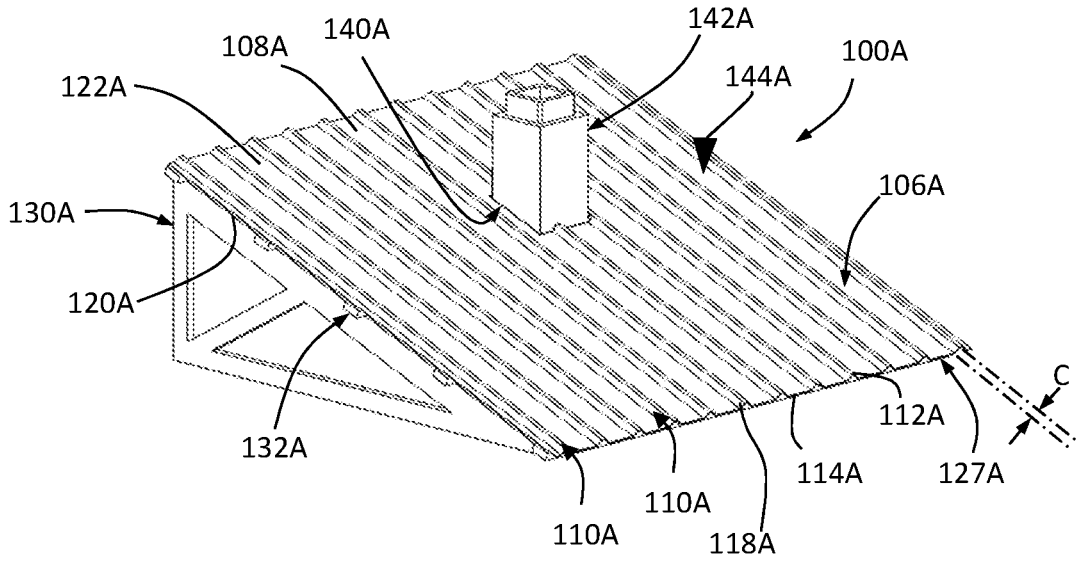
FIG. 1 depicts a perspective view of a corrugated roof assembly with sealing apparatus illustrating a sealing about a chimney according to one or more embodiments shown and described herein.
Figure 2:
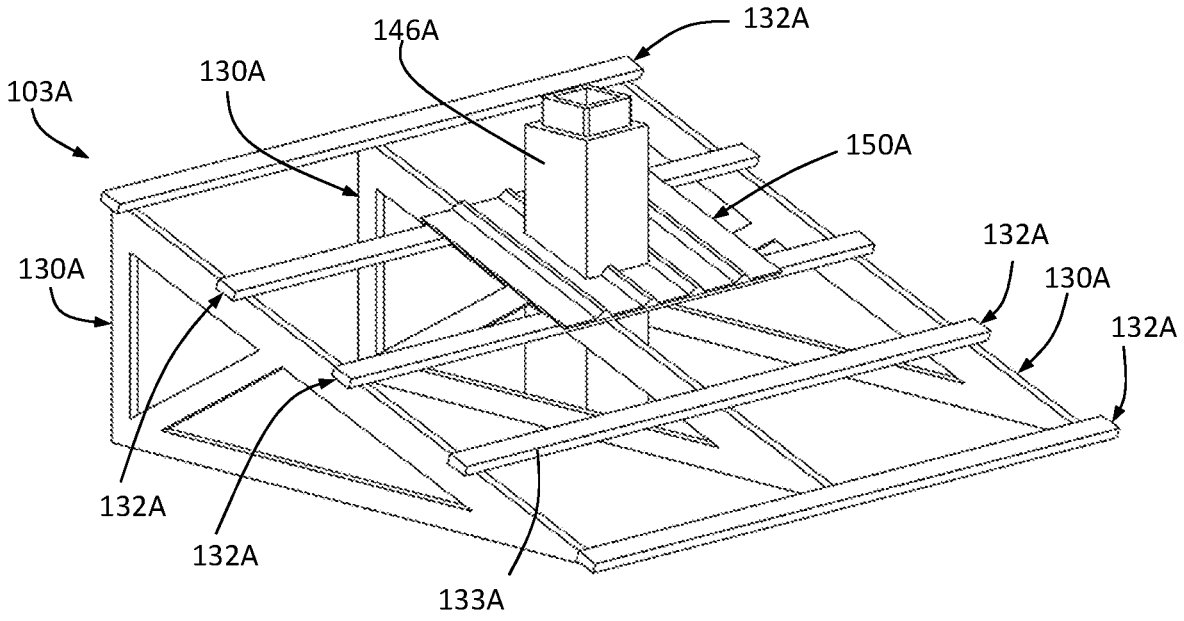
FIG. 2 depicts a perspective view of the corrugated roof assembly with sealing apparatus of FIG. 1 with corrugated sheet metal barrier removed according to one or more embodiments shown and described herein.
Figure 3:
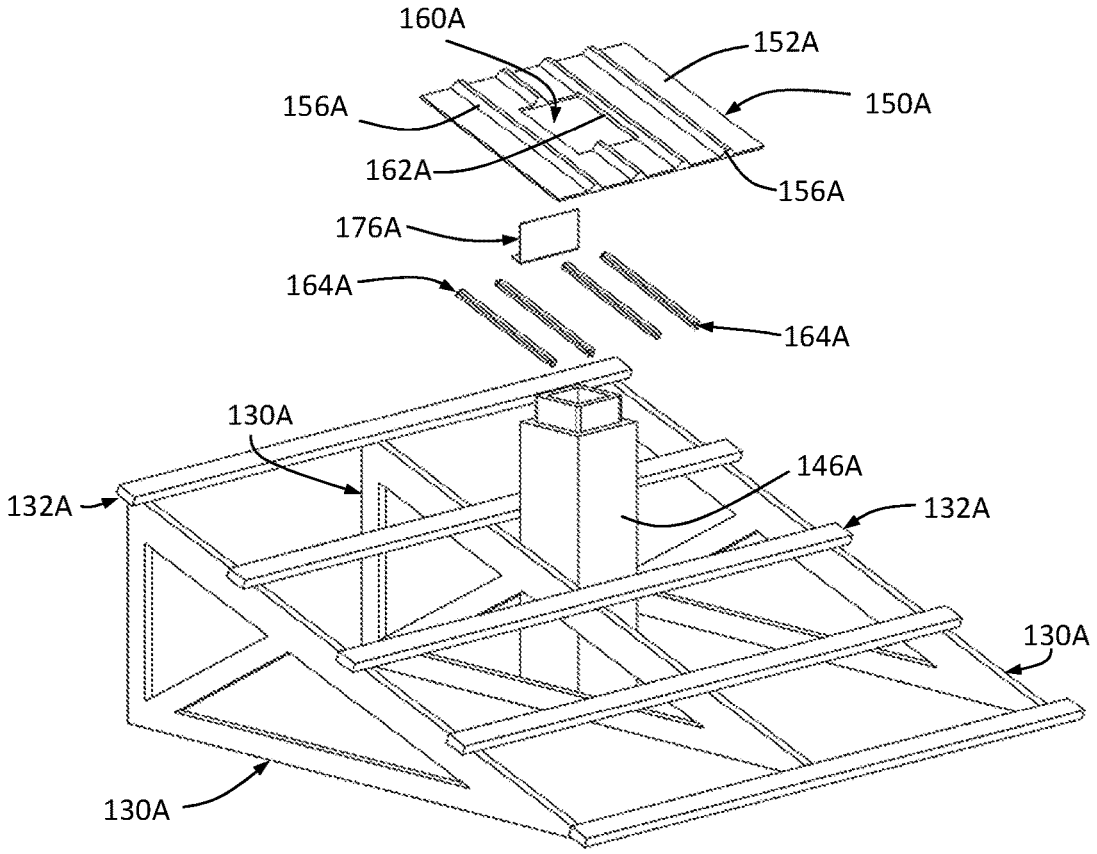
FIG. 3 depicts an exploded view of the corrugated roofing assembly with sealing apparatus of FIG. 1 with corrugated sheet metal barrier removed illustrating gasket supports according to one or more embodiments shown and described herein.
Figure 4A:
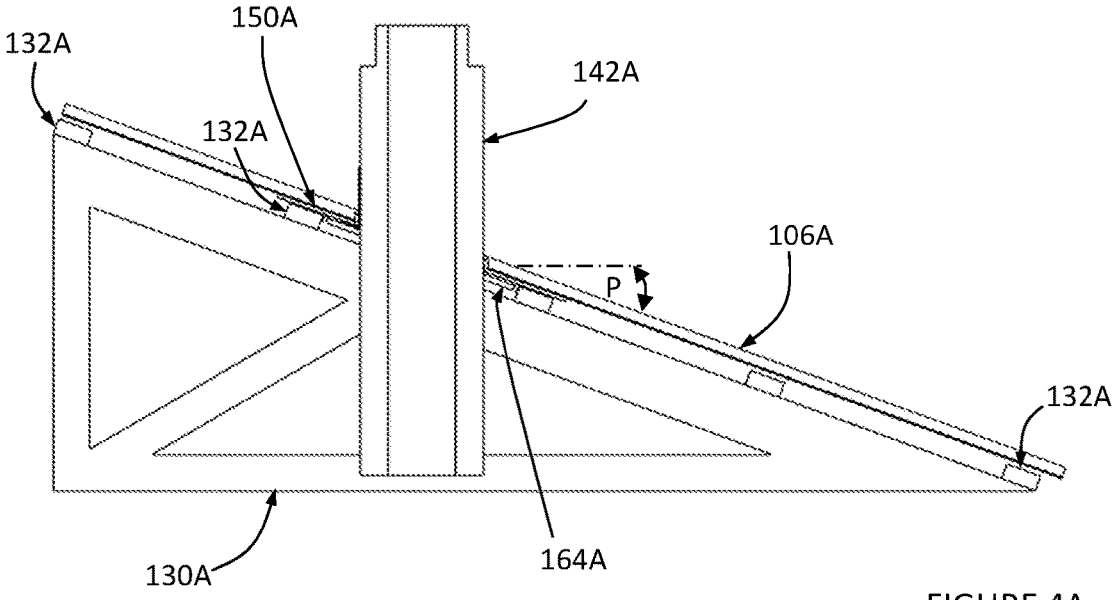
FIG. 4A depicts a cross-sectional view of the corrugated roofing assembly with sealing apparatus of FIG. 1 illustrating positioning of the sealing apparatus according to one or more embodiments shown and described herein.
Figure 4B:
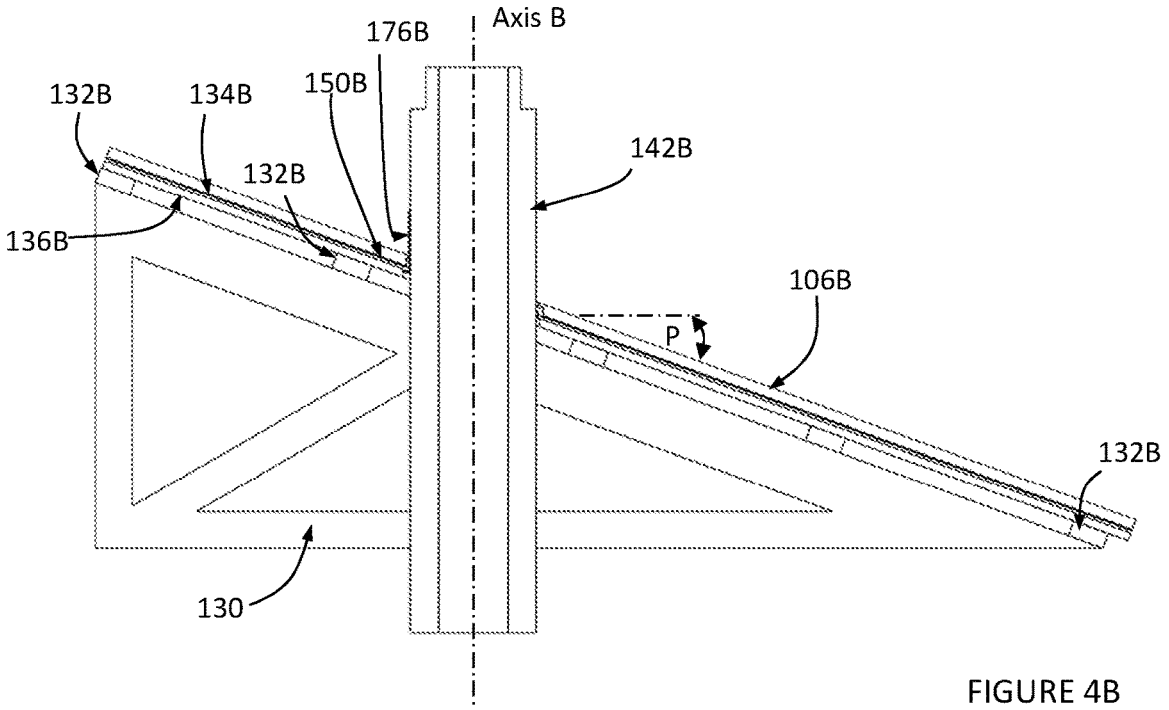
FIG. 4B depicts a cross-sectional view of a corrugated roofing assembly with sealing apparatus when installed over roof sheathing illustrating positioning of a sealing apparatus according to one or more embodiments shown and described herein.
Figure 5:
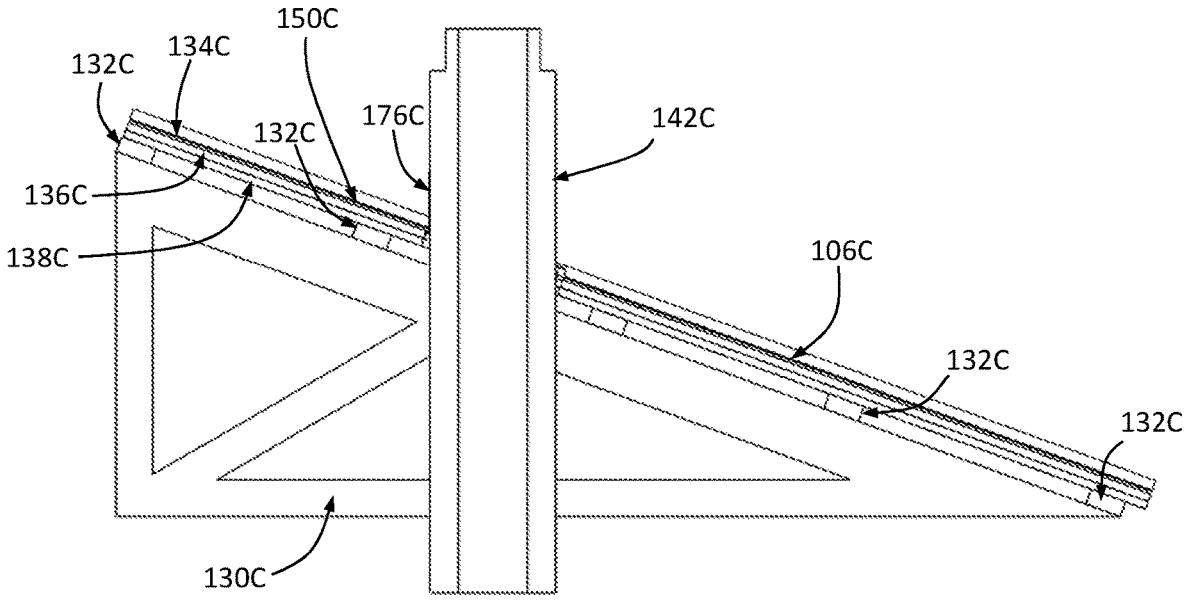
FIG. 5 depicts a cross-sectional view of a corrugated roofing assembly with sealing apparatus when installed over roof sheathing and insulation illustrating positioning of the sealing apparatus according to one or more embodiments shown and described herein.

In a preferred embodiment as illustrated in FIG. 1, a corrugated roof assembly with sealing apparatus 100A comprises a corrugated sheet metal barrier 106A. The corrugated sheet metal barrier 106A preferably comprises an anti-corrosive layer 108A. The anti-corrosive layer 108A may be in the form of one or more of; galvanized steel, a zinc coating, a polymer coating, and a paint coating. The corrugated sheet metal barrier 106A is shaped with a plurality of spaced generally linear elongate ribs 110A determining a corrugated thickness C (FIG. 1).

A corrugated sheet metal barrier 106A comprises a superior peak 112A and an inferior peak 114A at each linear elongate rib 110A defining a corrugated thickness 'C'. The corrugated sheet metal barrier 106A comprises a transition wall 118A between the superior peak 112A and inferior peak 114A. Corrugated sheet metal barrier 106A comprises an inner surface 120A facing a roofing truss structure 103A and an outer surface 122A facing the sky. The inferior edge where water would drip off is the drip edge 127A.

In this embodiment, each generally linear elongate rib 110A of a corrugated sheet metal barrier 106A is generally trapezoid shape 124A but may comprise other profiles such as sinusoidal 126A or of those known in the industry such as; 'classic rib', 'R panel', 'PBR panel', 'IJ Panel', 'Seam Loc', '*Magna* Loc', 'Image II', 'Soffit panel', '7.2 panel', '⅞" corrugated', 'Type B Wide rib', 'Type F Intermediate Rib', '2.5 inch rib', '1.5 inch composite', and '2 inch composite'. In this embodiment, corrugated sheet metal barrier 106A is coupled to roofing truss structure 103A and specifically to horizontally positioned purlins 132A of the roofing truss structure. In alternative embodiments, a corrugated sheet metal barrier 106B is coupled to one or more trusses 130B of a roofing truss structure 103B or to roof sheathing 136B such as plywood or OSB.

In some embodiments, an underlayment 134B is positioned just below a corrugated sheet metal barrier 106B. In some embodiments, roof sheathing 136B (i.e. plywood, OSB) is positioned between a corrugated sheet metal barrier 106A and a roofing truss structure 103B. Also in some embodiments, insulation 138 is positioned between a corrugated sheet metal barrier 106A and a roofing truss structure 103B. In any event, and according to the needs of the building structure; underlayment, roof sheathing, and insulation may be sandwiched between a corrugated sheet metal barrier 106 and a roofing truss structure 103. Roofing fasteners 144A such as one or more of; screws, nails, and staples are used to secure a corrugated sheet metal barrier 106B to purlins 132B, rafters, and/or other portions of a roofing truss structure 103B.

As illustrated in the Figures, a transition vessel 142A extends above an outer surface 122A and below an inner surface 120A of a corrugated sheet metal barrier 106A by passing therethrough. A transition barrier hole 140A is created within a corrugated sheet metal barrier 106A to provide passage of a transition vessel 142A therethrough. In this embodiment, a transition vessel 142A is in the form of a chimney 146A. In other embodiments, a transition vessel is in the form of one or more of; a chimney 146, a vent pipe 145, and a solar tube 147.

Figure 6:
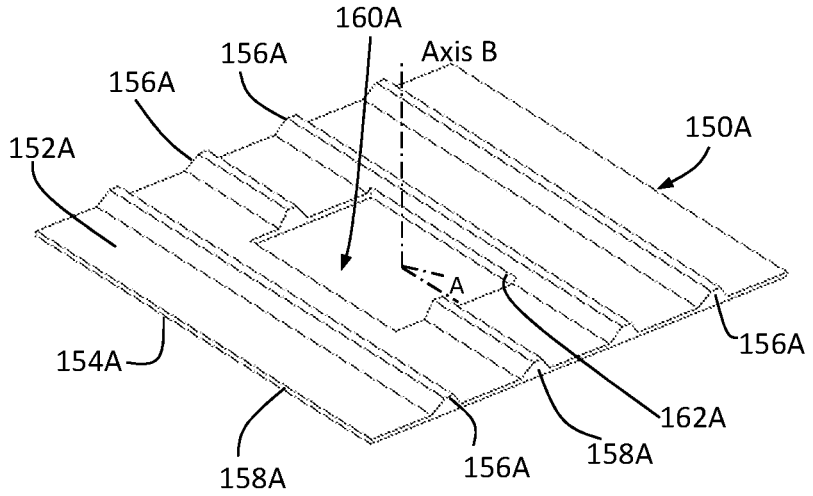
FIG. 6 depicts a perspective view of a gasket illustrating gasket ribs and a transition gasket hole according to one or more embodiments shown and described herein.
Figure 7:
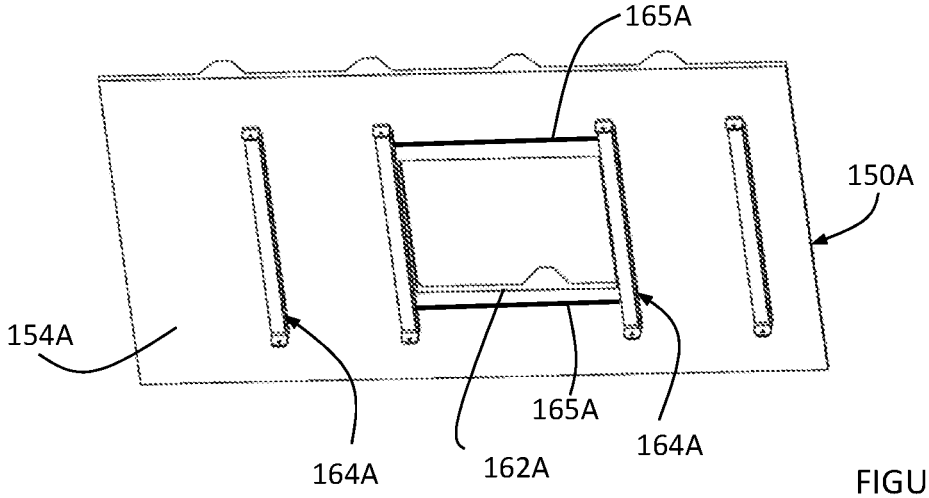
FIG. 7 depicts a perspective view of a gasket and a plurality of gasket supports according to one or more embodiments shown and described herein.
Figure 8:
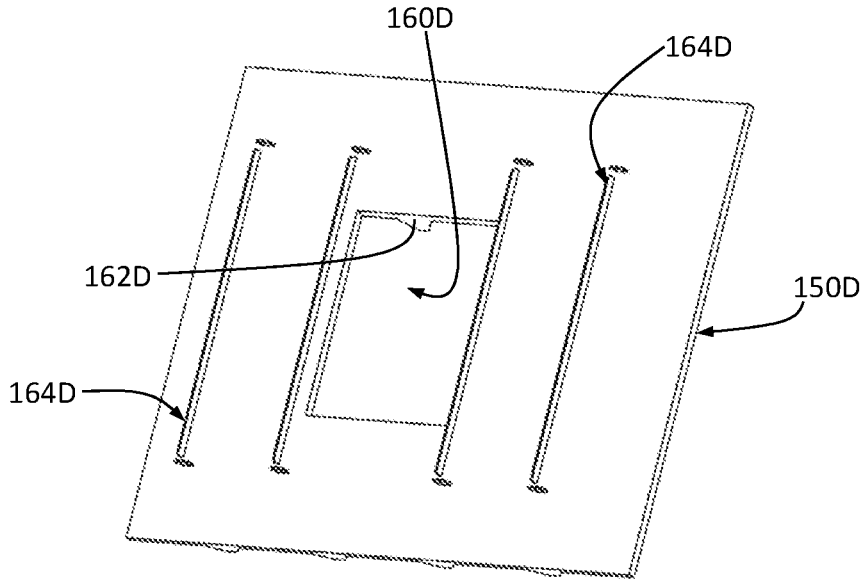
FIG. 8 depicts a perspective view of a gasket and a plurality of embedded gasket supports according to one or more embodiments shown and described herein.
Figure 11A:
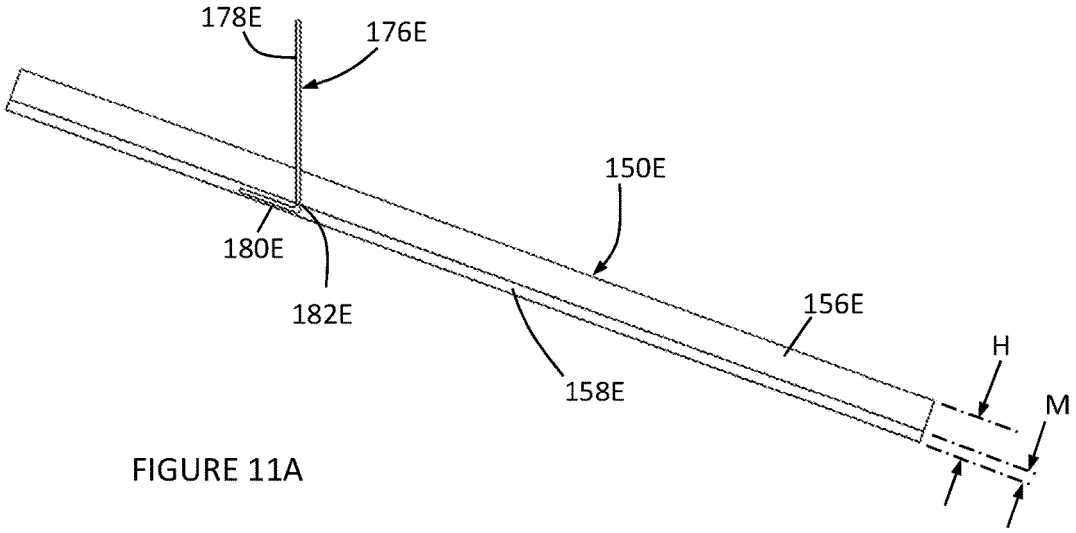
FIG. 11A depicts a side view of a gasket with embedded vessel flashing according to one or more embodiments shown and described herein.
Figure 11B:
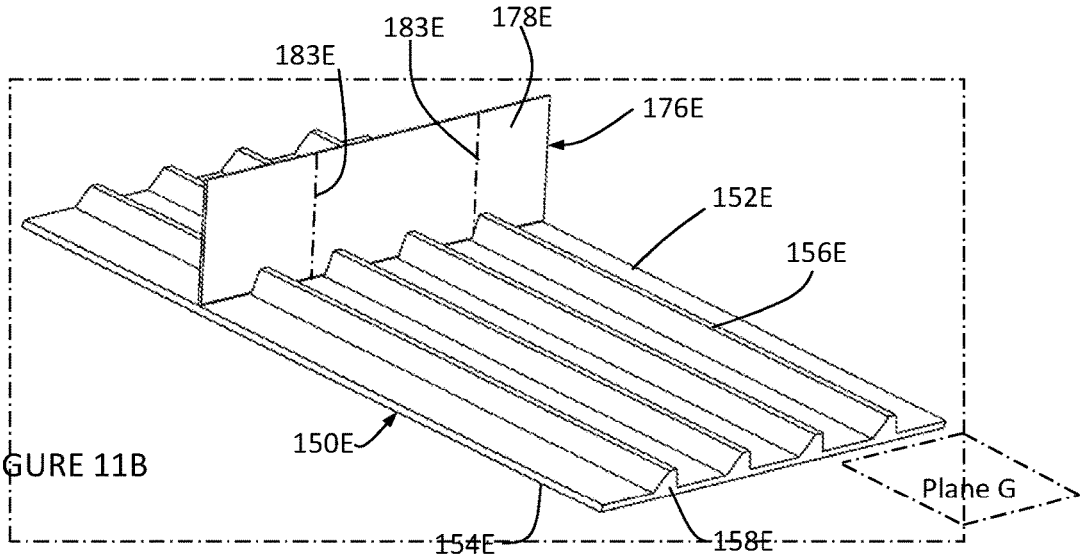
FIG. 11B depicts a perspective view of the gasket with embedded vessel flashing of FIG. 11A according to one or more embodiments shown and described herein.

In this embodiment, a sealing member is used between a roofing truss structure 103A and a corrugated sheet metal barrier 106A to prevent leakage therebetween. In preferred forms such as illustrated in FIG. 6, a sealing member is in the form of a gasket 150A. The gasket 150A comprises an upper surface 152A wherein said upper surface comprises a profile generally complementing an inner (facing) surface 120A of a corrugated sheet metal barrier 106A. For example, upper surface 152A comprises gasket ribs 156A which complement linear elongate ribs 110A formed in an inner facing surface 120A (inner surface) of corrugated sheet metal barrier 106A. Gasket 150A comprises a lower surface 154A which in this embodiment is generally flat but may assume other profiles. As illustrated in FIGS. 11A and 11B, gasket 150E comprises a height thickness 'H' extending between a superior most part of it's upper surface 152E and most inferior most part of its lower surface 154E. Gasket 150E also comprises a perimeter surface 158E extending between adjacent portions of said upper surface 152E and lower surface 154E. In some embodiments, a minimal height of the gasket perimeter surface 158E is material thickness 'M'. A perimeter surface 158E defines a gasket 150E foot print that is larger than the cross sectional size of a corresponding transition vessel.

A transition gasket hole 160A is positioned inward gasket perimeter surface 158A and extends between said upper surface 152A and lower surface 154A of gasket 150A. In this embodiment, gasket ribs 156A on gasket 150A are aligned with linear elongate ribs 110A on corrugated sheet metal barrier 106A and a transition gasket hole 160A is cut by a user through gasket 150A wherein the gasket hole and said transition barrier hole 140A are generally aligned for passage of a transition vessel 142A therethrough. In this manner, the gasket may be fitted to accommodate any position of a transition vessel regardless of position of the linear elongate ribs 110A of corrugated sheet metal barrier 106A.

As illustrated in FIG. 6, a transition gasket hole 160A is defined by a transition gasket hole surface 162A and comprises a size and profile for passage of a corresponding transition vessel 142A. In some forms, transition gasket hole 160A is sized to provide a stretch fit about a transition vessel 142A however a caulk or other sealant may be used to make this and other adjacent junctions water tight.

In this embodiment, transition gasket hole 160A is used on a roof having a pitch 'P'. Consequently transition gasket hole 160A is preferably formed at an angle 'A' to reflect this pitch along axis B through height thickness 'H' of gasket 150A to provide passage of a generally vertical transition vessel 142A. An upper surface distance between a perimeter surface 158A and transition gasket hole surface 162A of gasket 150A is made sufficient to provide a seal against fluid leakage between gasket 150A and corrugated sheet metal barrier 106A.

Figure 9A:
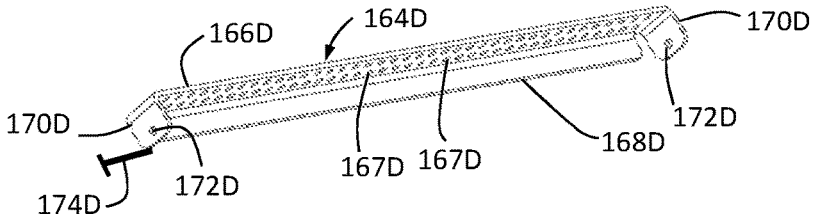
FIG. 9A depicts a perspective view of a gasket support with embedding holes according to one or more embodiments shown and described herein.
Figure 9B:
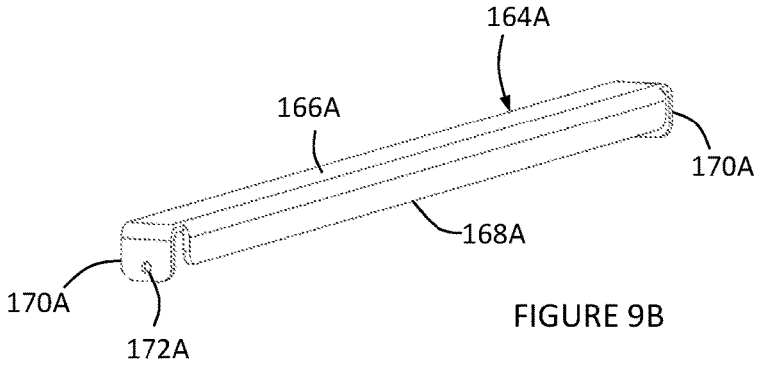
FIG. 9B depicts a perspective view of a gasket support according to one or more embodiments shown and described herein.

In this embodiment, one or more gasket supports 164A are fixed to a portion of a roofing truss structure 103A. A support surface 166A (FIG. 9B) on gasket support 164A abuts a lower surface 154A of said gasket 150A thereby maintaining the gasket pressed against an inner surface 120A of a corrugated sheet metal barrier 106A. In an alternative embodiment, a support surface 166D on a gasket support 164D is embedded by mold or adhesive in a lower surface 154D of gasket 150D thereby maintaining the gasket pressed against an inner surface 120D of a corrugated sheet metal barrier 106D. In this embodiment, one or more embedding holes 167D perforate a support surface 166D of gasket support 164D. Gasket support 164D comprises a stiffness flange 168D extending from the support surface to provide stiffness to the gasket support. Fixation flanges 170D are positioned at one or more ends of the one or more gasket supports 164D and may comprise a fixation hole 172D for housing a fixation fastener 174D such as a nail, or screw used for fixation to a portion of a roofing truss structure or purlin. In alternative embodiments, such as when roof sheathing is used under a corrugated sheet metal barrier, gasket supports are unnecessary as gasket 150A is supported on its lower surface 154A by the roof sheathing 136.

In preferred forms, gasket support 164A is elongate having a length for fitting between a pair of spaced purlins 132A and with each fixation flange 170A adjacent a side purlin wall 133A for fixation thereto. A plurality of gasket supports 164A fixedly extending between opposed purlins 132A support gasket 150A against an inner surface 120A of a corrugated sheet metal barrier 106A. In some embodiments, a secondary gasket support 165A extends between a pair of spaced gasket supports 164A in a generally horizontal orientation to provide gasket support around all sides of a transition vessel. The gasket supports may be formed from a variety of materials including but not limited to a metal rod, a polymer, and a wood plank. In some embodiments, gasket supports 164A are adjustable in length to accommodate varying distances between anchor members of a roofing truss structure.

In some embodiments, a vessel flashing 176A is used to provide further protection against leakage. For example and as illustrated in FIGS. 1-4A, 10A-10B, vessel flashing 176A comprises a vessel portion 178A (for alignment against a transition vessel) and a gasket portion 180A extending at an angle for alignment with a gasket 150A. In one embodiment, gasket portion 180A is fitted adjacent lower surface 154A of gasket 150A. In other embodiments (FIG. 11A) gasket 150E comprises a portion of one or more pieces of vessel flashing 176E embedded in the body of gasket 150E. Here, vessel flashing 176E comprises an elongate break notch 182E at an inferior end of vessel portion 178E for breaking the vessel portion from a gasket portion 180E after trimming vessel flashing 176E to a predetermined width (at trim lines 183E) at a predetermined location for abutment against a corresponding transition vessel 142E.

Figure 10A:
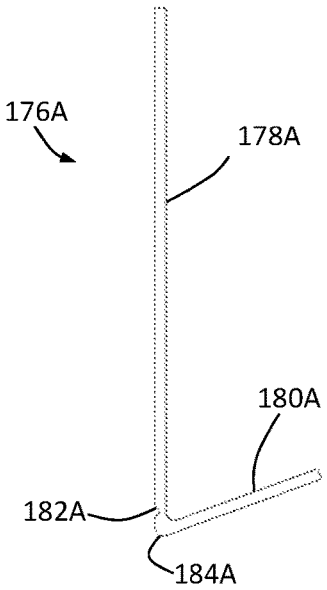
FIG. 10A depicts an end view of a vessel flashing illustrating a break notch according to one or more embodiments shown and described herein.
Figure 10B:
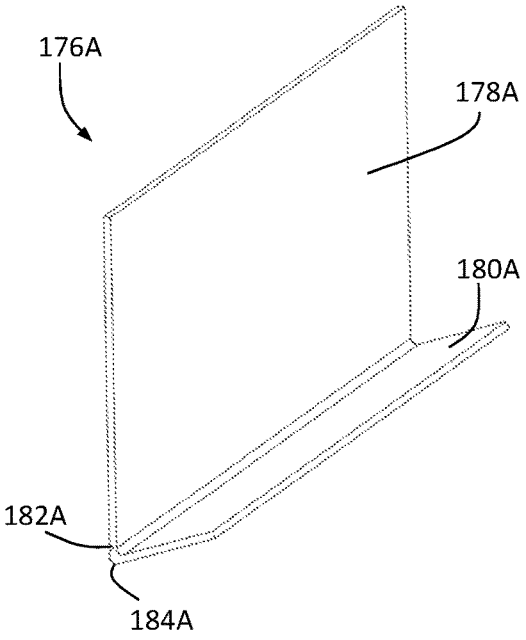
FIG. 10B depicts a perspective view of a vessel flashing illustrating a flashing bend according to one or more embodiments shown and described herein.

As illustrated in FIGS. 10A and 10B, vessel flashing 176A comprises an upright vessel portion 178A for general alignment with an outer face of a transition vessel 142A, and a gasket portion 180A generally aligned within a gasket plane 'G'. A vessel flashing 176A comprises a flashing bend 184A between the vessel portion 178A and the gasket portion 180A. In some embodiments, vessel portion 178A is generally vertical. An angle 'A' between a horizontal and a gasket portion is generally the same as the slope of the corresponding roof.

Figure 12:
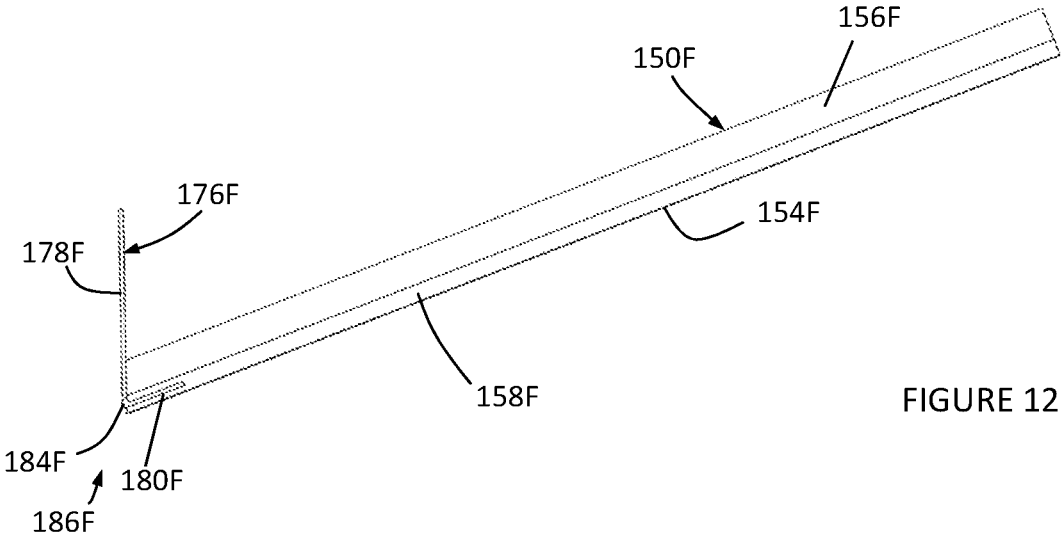
FIG. 12 depicts a side view of a vessel flashing embedded within a low end of a perimeter surface of a gasket according to one or more embodiments shown and described herein.

In another embodiment, as illustrated in FIG. 12, a vessel portion 178F of a vessel flashing 176F extends upward from a low end 186F of a perimeter surface 158F of a gasket 150F. In this embodiment, gasket portion 180F is mold embedded into low end 186F of perimeter surface 158F. In alternative embodiments, gasket portion may be sealed using adhesives in a low end of perimeter surface 158F groove or may be bonded to lower surface 154F of gasket 150F.

Figure 13:
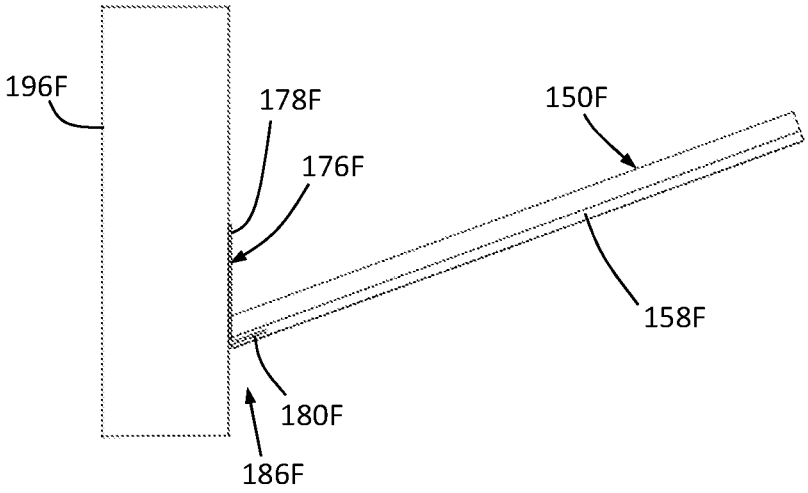
FIG. 13 depicts a side view of a vessel flashing embedded within a low end of a perimeter surface of a gasket according to one or more embodiments shown and described herein.
Figure 14:
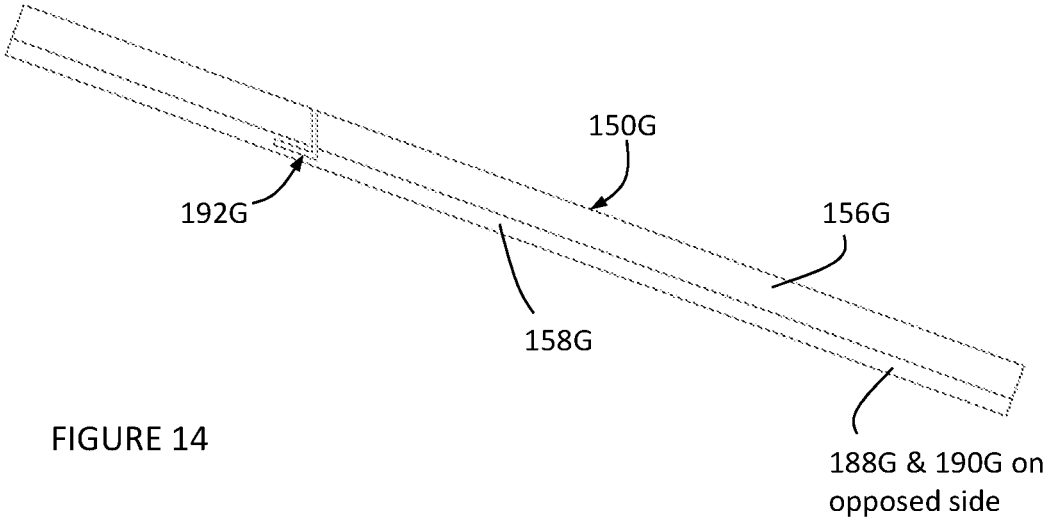
FIG. 14 depicts a side view of a gasket having a flash channel according to one or more embodiments shown and described herein.
Figure 15:
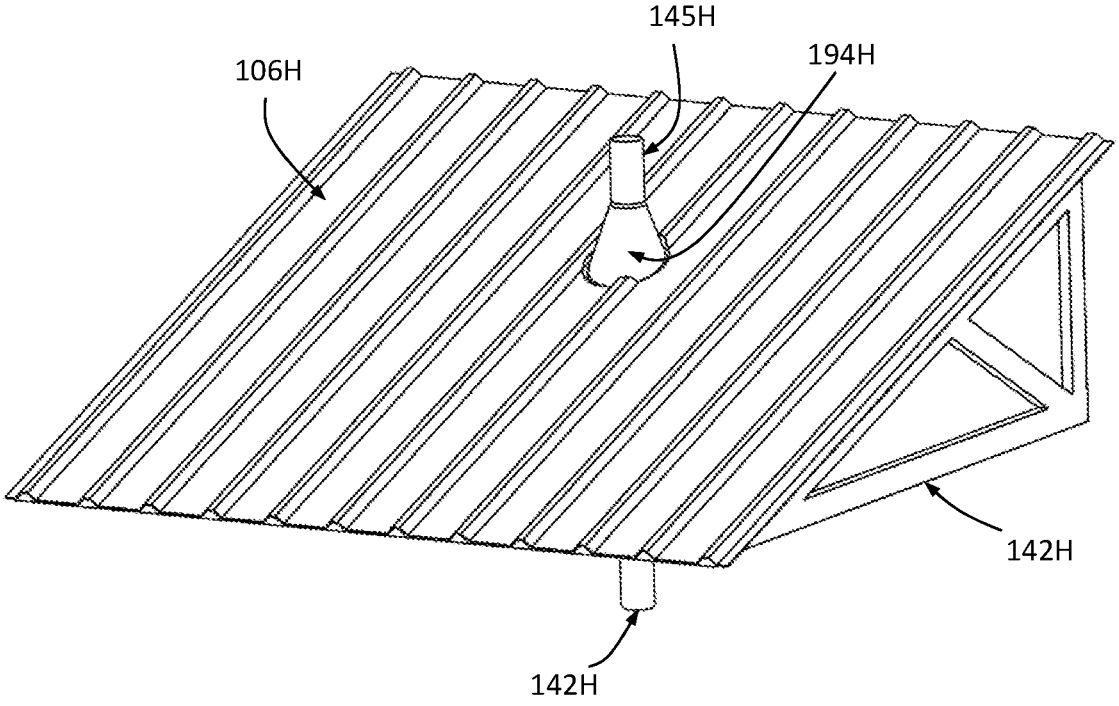
FIG. 15 depicts a perspective view of a corrugated roof assembly with a sealing apparatus about a vent pipe according to one or more embodiments shown and described herein.
Figure 16:
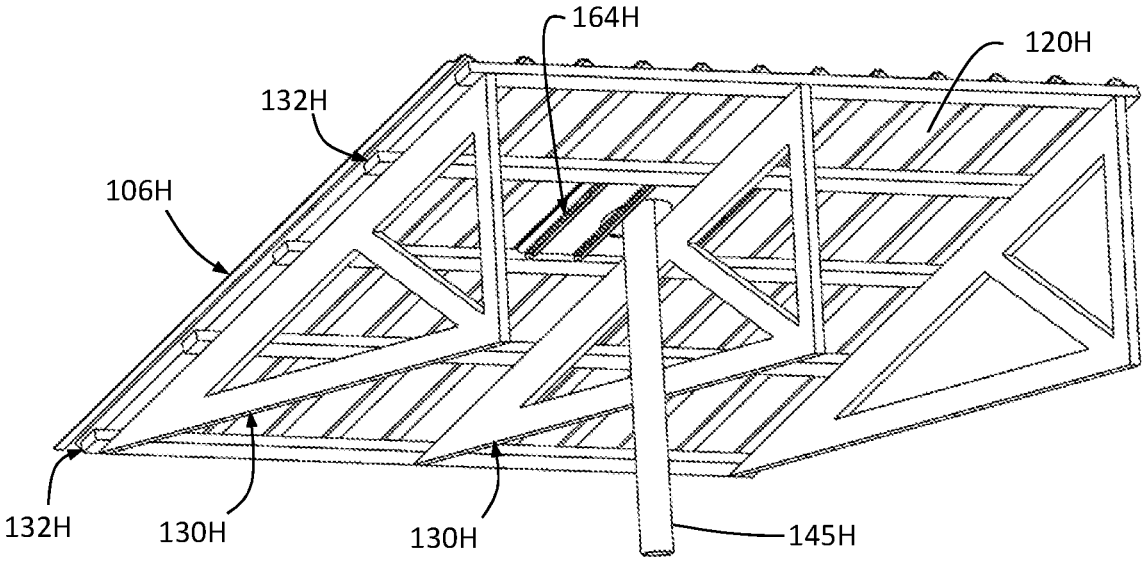
FIG. 16 depicts a lower perspective view of the corrugated roof assembly with a sealing apparatus of FIG. 15 illustrating the use of gasket supports according to one or more embodiments shown and described herein.
Figure 17:
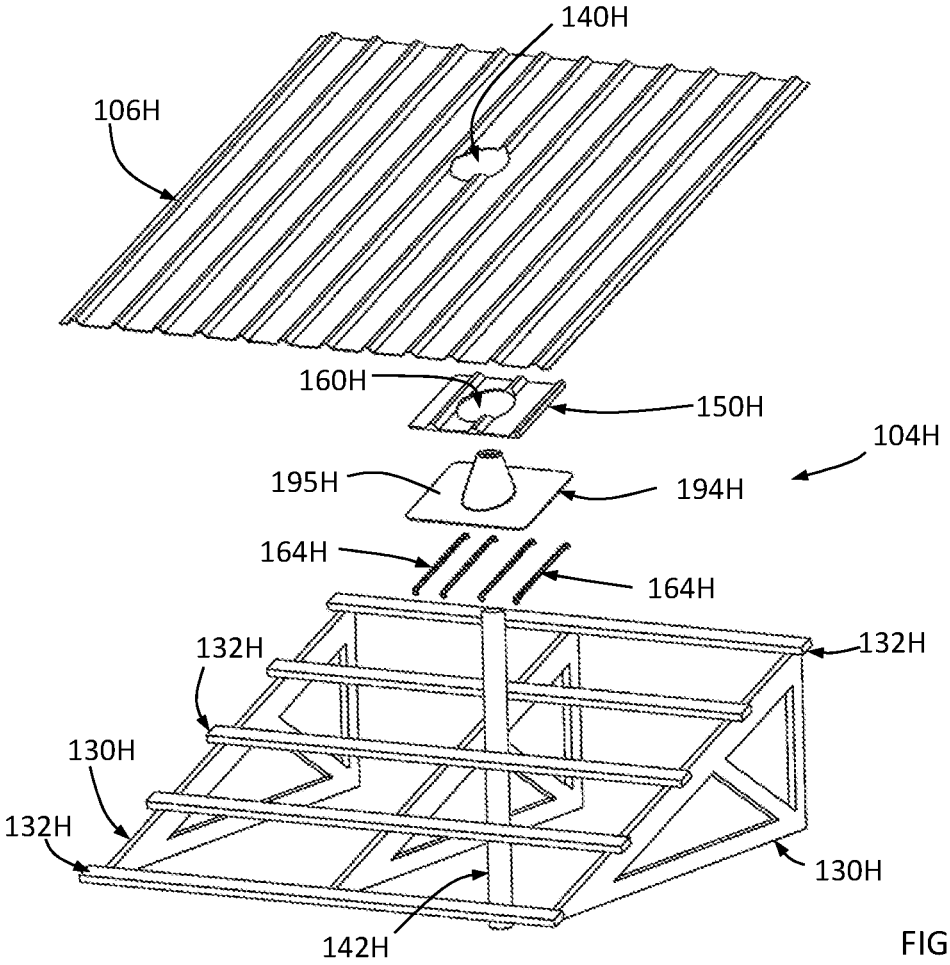
FIG. 17 depicts an exploded perspective view of the corrugated roof assembly with sealing apparatus of FIG. 15 according to one or more embodiments shown and described herein.
Figure 18:
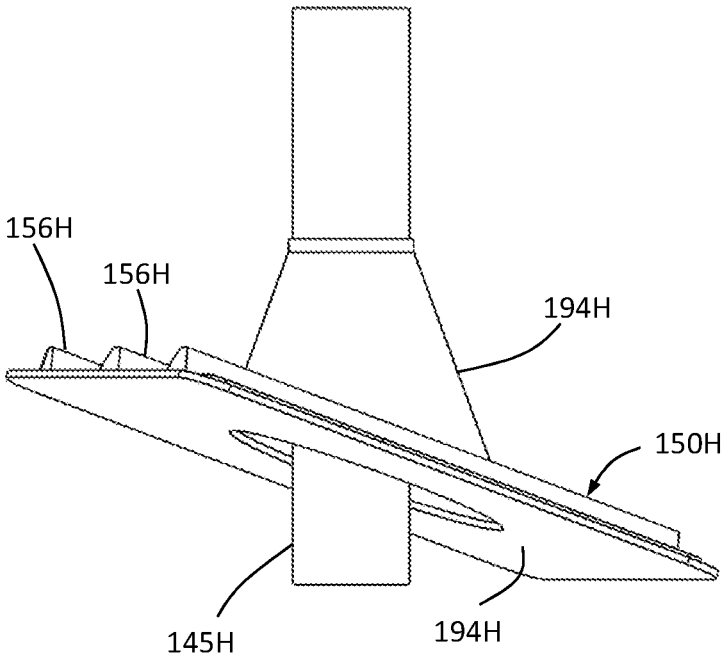
FIG. 18 depicts a low perspective view illustrating use of a gasket with a vent boot according to one or more embodiments shown and described herein.
Figure 19:
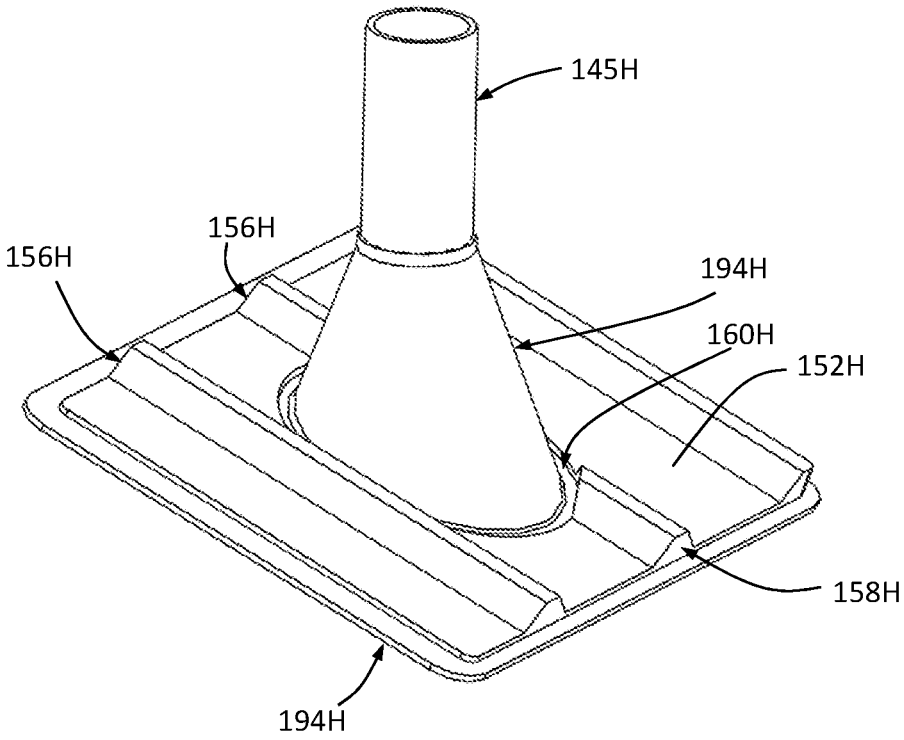
FIG. 19 depicts a high perspective view illustrating use of a gasket with a vent boot according to one or more embodiments shown and described herein.
Figure 20:
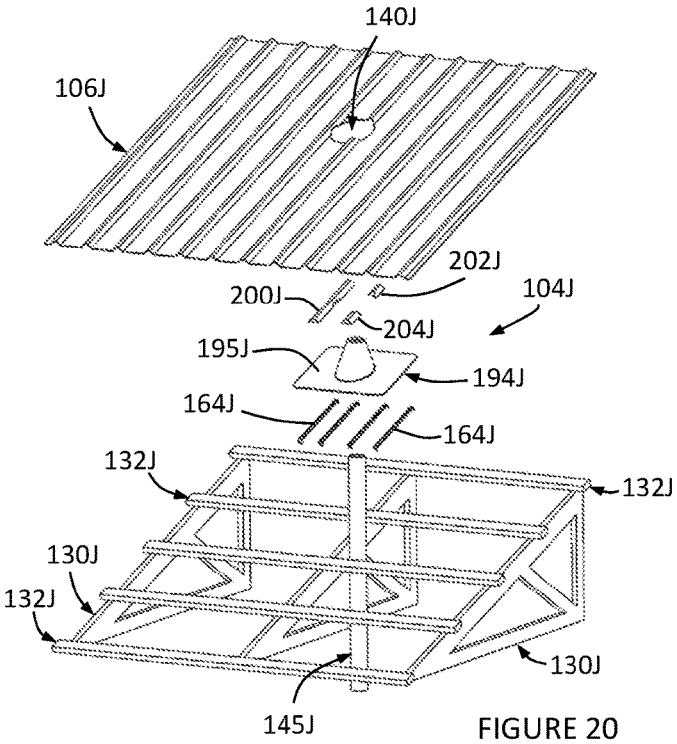
FIG. 20 depicts a high perspective exploded view illustrating use of a gasket in the form of gasket plugs with a vent boot according to one or more embodiments shown and described herein.
Figure 21:
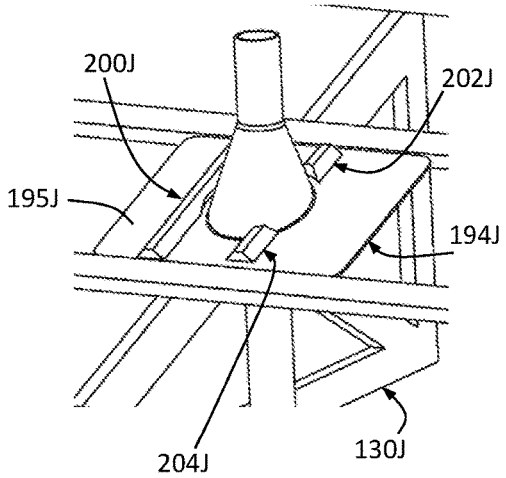
FIG. 21 depicts a close up view illustrating use of a gasket in the form of gasket plugs with a vent boot and with corrugated sheet metal barrier removed according to one or more embodiments shown and described herein.

As illustrated in FIG. 13, a vessel portion 178F of a vessel flashing 176F abuts a building wall 196F of a building at a low end 186F of a roofing truss structure 103F (not shown). A gasket portion 180F of vessel flashing 150F is embedded in a low end of a perimeter surface 158F. Vessel portion 178F is sealed with a sealant at building wall 196F. This arrangement eliminates leakage that can occur on a sloped corrugated roof that terminates abutting a wall rather than terminating at a gutter system that can carry away rain and melting snow.

In yet another embodiment, a gasket 150G comprises a generally linear flash channel 192G extending from a first side 188G of a perimeter surface 158G to a second side 190G of perimeter surface 158G wherein said generally linear flash channel 192G is sized and shaped to seat a gasket portion 180G of a vessel flashing 176G. A viscous sealant may be applied within the generally linear flash channel 192G for sealed seating of vessel flashing 176G. In this embodiment, a vessel flashing 176G is trimmed in length to complement width of a corresponding transition vessel and inserted in the flash channel 192G in a predetermined position. In one embodiment, a flash channel 192G is formed in a low end of a perimeter surface 158G to seat a gasket portion 180G of a vessel flashing 176G when used in a manner as illustrated in FIG. 13.

In yet another embodiment and as illustrated in FIG. 15-19, a ribbed gasket 150H is positioned between an inner surface 120H of a corrugated sheet metal barrier 106A and a superior surface 195H of a vent boot 194H and supported by one or more gasket supports 164H. Again, the seams encircling a sealing apparatus 104H within a corrugated roof assembly 100 may be sealed with caulk or other sealant. Alternatively, when roof sheathing is used above trusses or rafters, gasket 150H is sandwiched between the corrugated sheet metal barrier 106H and roof sheathing 136H.

In alternative forms, a sealing apparatus for corrugated roofing comprises lengths of a gasket plug. In some embodiments, the gasket plugs may be of a single length or may comprise a plurality of lengths. For example, various length of a gasket plug may comprise one or more of a first length gasket plug 214J, a second length gasket plug 216J, a third length gasket plug 218J, and a fourth length gasket plug 220J. In one embodiment, gasket plugs are sold as a kit in lengths and quantities needed for a particular task such as sealing around a vent pipe. Each gasket plug comprises an elongate profile matching a corrugation profile of a corresponding corrugated sheet metal barrier. In preferred embodiments, a gasket plug is polymeric and may be rigid or flexible.

Figure 23:
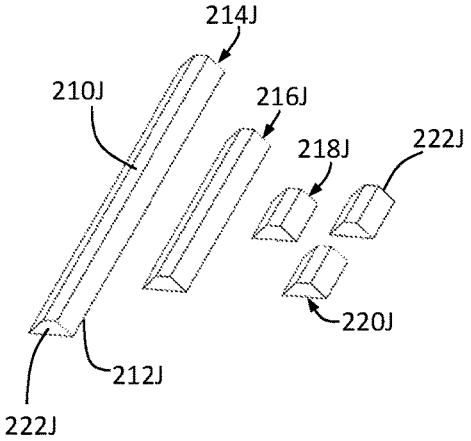
FIG. 23 depicts a perspective view of a plurality of gasket plugs of various lengths according to one or more embodiments shown and described herein.
Figure 28:
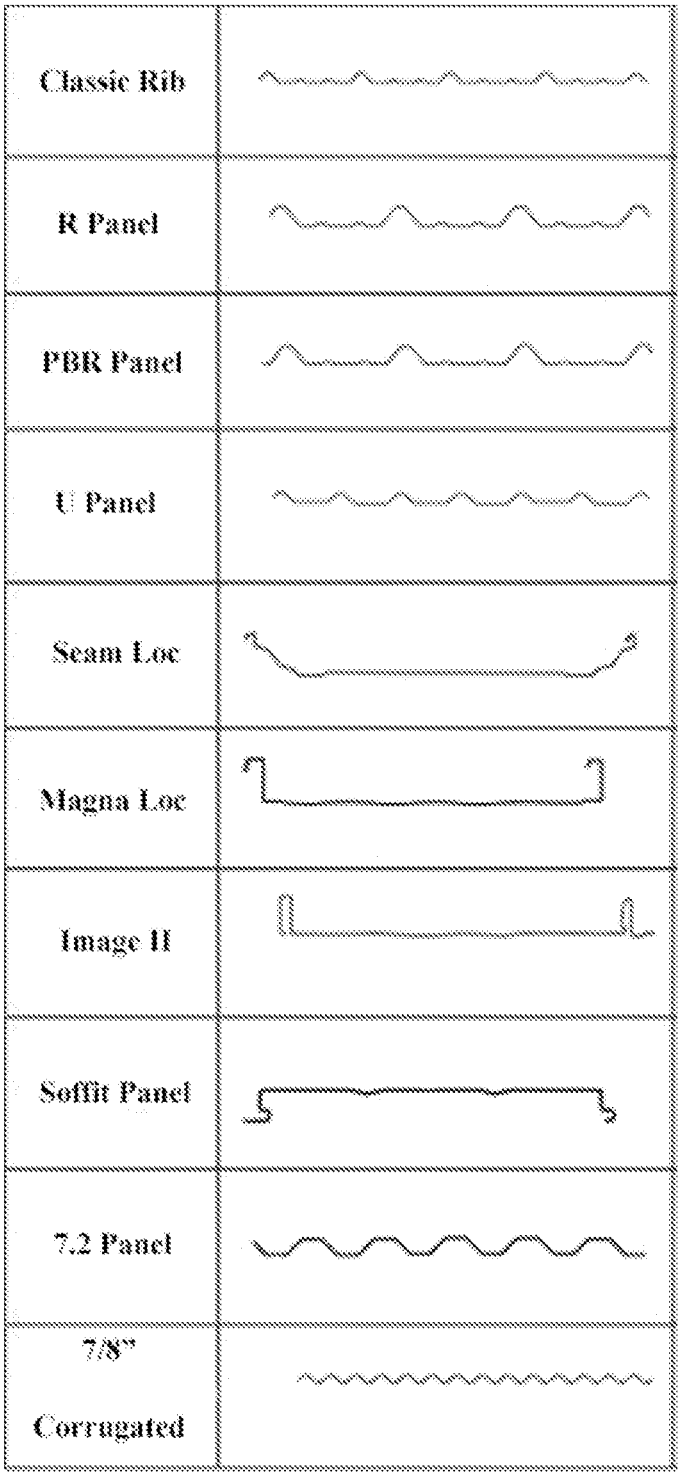
FIGURE 28 PRIOR ART
FIG. 28 is a diagram illustrating just a few of the corrugated metal roofing profiles available in the prior art.

In a preferred embodiment, a gasket plug is of an extended length and is cut into a plurality of shorter lengths by a user as required for a particular application. For example, a user may purchase a first length gasket plug 214J which can be cut with a utility knife, saw, or similar tool into one or more shorter length second, third, or fourth length gasket plugs. As illustrated in FIG. 23, each gasket plug comprises a metal facing surface 210J and an opposed ground facing surface 212J wherein the profile of the metal facing surface 210J generally complements a corresponding corrugated metal roofing profile and the ground facing surface 212J is generally planar. Each gasket plug terminates at a gasket end 222J. An incomplete list of profiles of corrugated sheet metal barriers are illustrated in FIG. 28, however may more exist.

In an installed configuration, the ground facing surface 212J of a gasket plug is positioned against one or more of: a roof sheathing, an underlay membrane such as felt saturated with asphalt or a synthetic fabric, flashing, and an upward facing surface of a vent boot. Further in an installed configuration, at least a portion of one or more of a metal facing surface and an opposed ground facing surface is covered with sealant before positioned between a corrugated sheet metal barrier and an inferiorly supporting surface such one of: an upward facing surface of a vent boot, an underlay membrane, flashing, roof sheathing, and roofing underlayment. Preferably sealant is applied as a first sealant bead 206J and an optional second sealant bead 208J circumferentially spaced radially about the transition barrier hole 140J in the corresponding corrugated sheet metal barrier 106J as illustrated in FIG. 22.

Figure 22:
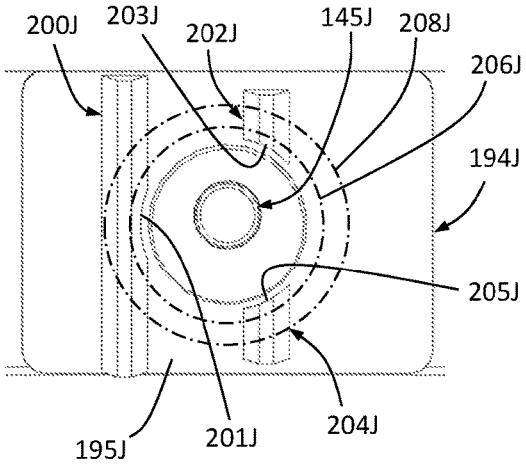
FIG. 22 depicts a top view illustrating use of a gasket in the form of assembly of trimmed gasket plugs with a vent boot according to one or more embodiments shown and described herein.

Also illustrated in FIG. 22, one or more gasket plugs (i.e. first length gasket plug 214J, second length gasket plug 216J, third length gasket plug 218J, fourth length gasket plug 220L) comprises a trimmed portion to provide clearance for structures extending through the corresponding corrugated sheet metal barrier. This is also illustrated for example in FIG. 22 as first trimmed section 201J of first gasket plug 200J, and second trimmed section 203J of second gasket plug 202J, and third trimmed section 205J of third gasket plug 204J, provide clearance for vent pipe 145J and the upward protruding portion of vent boot 194J. As noted from the figure, first gasket plug 200J is trimmed on a side whereas second gasket plug 202J and third gasket plug 204J are trimmed on an end.

Figure 24:
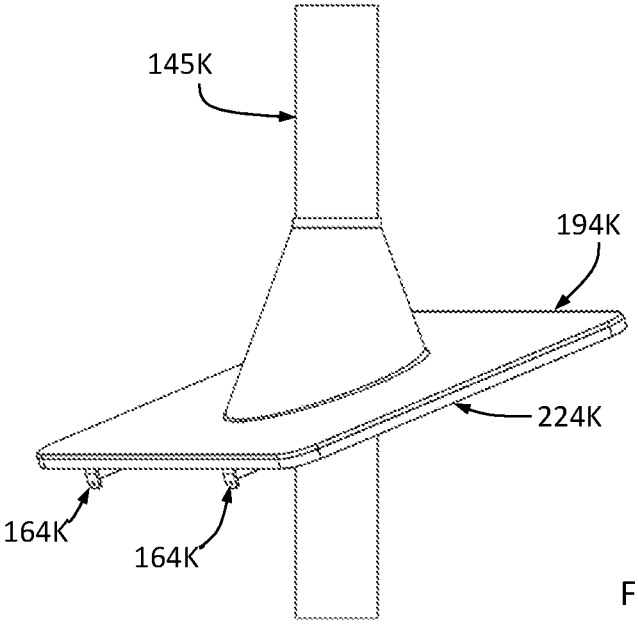
FIG. 24 depicts a perspective view of a vent boot reinforced by a support plate and a plurality of gasket supports according to one or more embodiments shown and described herein.
Figure 25:
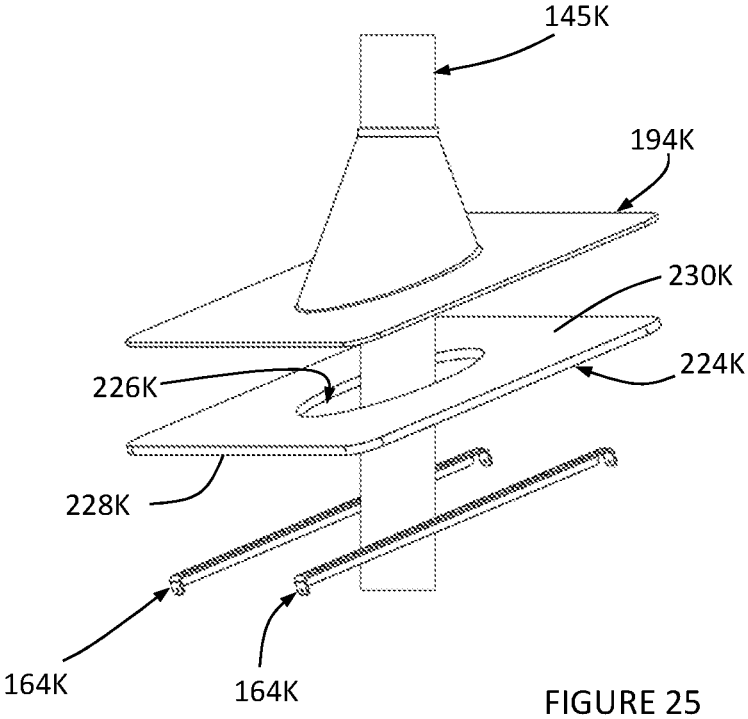
FIG. 25 depicts an exploded view of the vent boot, support plate, and gasket supports illustrated in FIG. 24.

In instances where a corrugated sheet metal barrier roof is used in the absence of roof sheathing (i.e. the corrugated sheet metal barrier is fastened direct to the purlins), a support plate 224K may be utilized to support superior structures such as a vent boot 194K. Such an arrangement is illustrated in FIG. 24-25. In preferred forms, the support plate is plywood and comprises a support plate aperture 226K for passage of structures such as a vent or chimney extending through an inferior face 228K and superior face 230K of support plate 224K. In preferred embodiments, the support plate 224K is fixed in position by one or more gasket supports 164K.

A preferred embodiment of a method for sealing a transition vessel extending through one or more of a corrugated roof and siding comprises the following steps and is illustrated in FIG. 25. A designated roof or wall is framed 232 including creating a fully supported opening of a size sufficient for passage of a transition vessel 234 through the plane of the corresponding wall or roof. Install a transition vessel (i.e. such as a chimney, plumbing vent, electrical, etc.) and secure the transition vessel in place 236 per common practices or manufacturers standards. Install a flashing having a flat sealable flange to the transition vessel 238. Begin installation of the corresponding corrugated sheet metal barrier (i.e. roofing, siding) at a convenient starting point. When the corrugated sheet metal is advanced to the point of encountering a transition vessel (or other protuberance), the position, shape, and size of a transition barrier hole is determined. A predetermined transition barrier hole is then cut through the corresponding corrugated sheet metal barrier 240. The corrugated sheet metal barrier is positioned on the corresponding roof or wall with the transition vessel extending therethrough to validate proper transition barrier hole position 242. The corrugated sheet metal barrier with transition barrier hole is removed and a ribbed gasket is joined generally centered over the newly cut transition barrier hole. Gasket ribs are positioned to align and occupy ribs on the corrugation profile on the back side of the corrugated sheet metal barrier. Using the outline of the transition barrier hole in the corrugated sheet metal barrier as a template, a transition gasket hole is cut in the corresponding gasket 244. Any undesired excess material is then cut from the periphery of the gasket. Sealant is then applied to a top side of corresponding flashing 246. The prepared gasket is placed over the transition vessel with the generally flat side facing the flange seated down upon the bed of sealant on the flashing. A bed of sealant is then applied to the upper surface and gasket ribs of the prepared gasket preferably around the entire periphery of the transition gasket hole to prevent water seepage 248. The prepared corrugated sheet metal barrier is then placed over the top of the gasket with gasket ribs aligned with the corrugations of the metal 250. The prepared corrugated sheet metal barrier is then secured according to manufacturer's recommendations 252. If a support plate is utilized, the method may include supporting the support plate by fastening gasket support between adjacent purlins or other frame structure.

Figure 26:
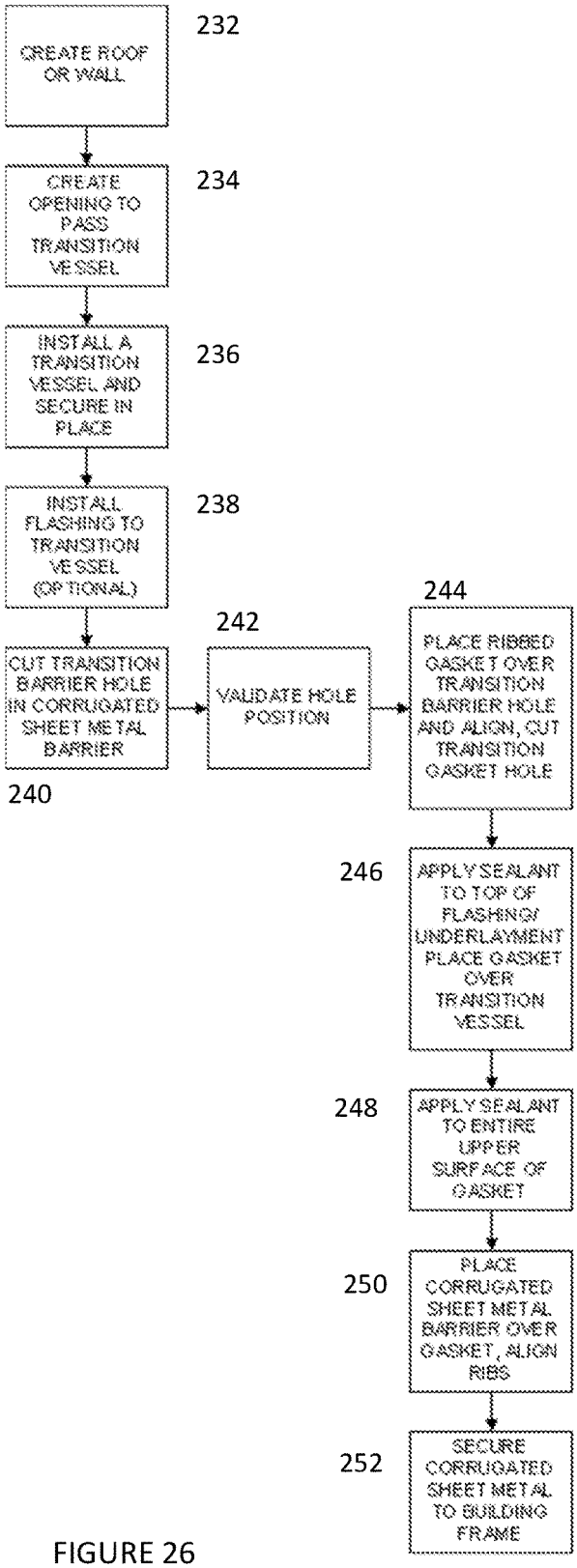
FIG. 26 is a flow diagram illustrating a method for use of a gasket in a corrugated roof assembly according to one or more embodiments shown and described herein.
Figure 27:
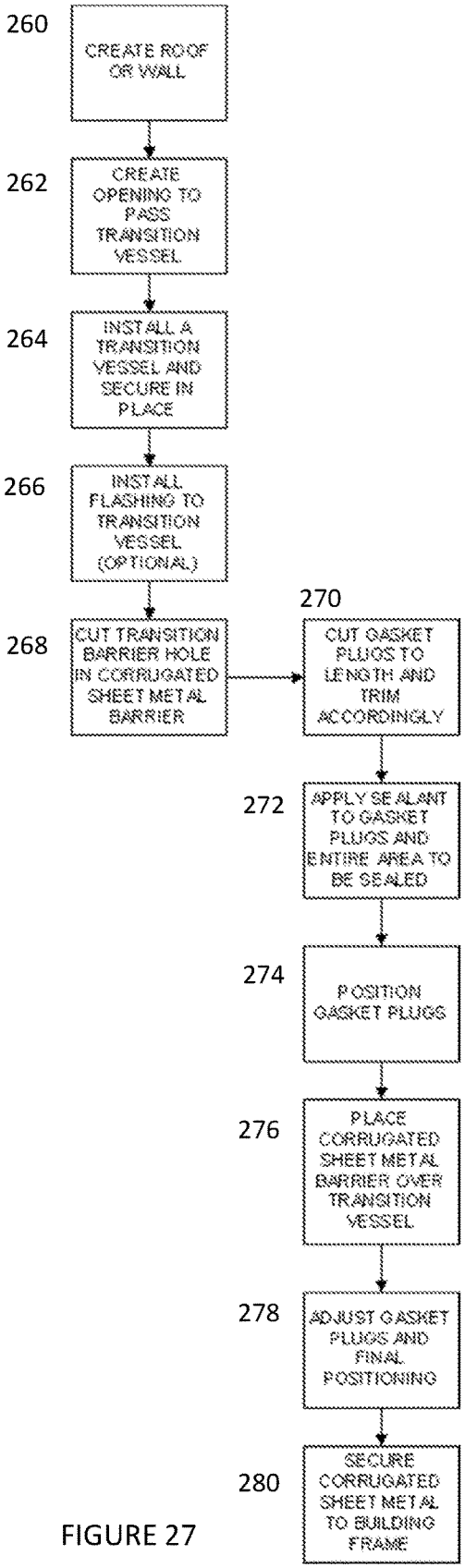
FIG. 27 is a flow diagram illustrating a method for use of gasket plugs in a corrugated roof assembly according to one or more embodiments shown and described herein.

In another preferred embodiment of a method for sealing a transition vessel extending through one or more of a corrugated roof and siding comprises the following steps and is illustrated in FIG. 26. A designated roof or wall is framed 260 including creating a fully supported opening of a size sufficient for passage of a transition vessel 262 through the plane of the corresponding wall or roof. Install a transition vessel (i.e. such as a chimney, plumbing vent, electrical, etc.) and secure the transition vessel in place 264 per common practices or manufacturers standards. Install a flashing having a flat sealable flange to the transition vessel 266. Begin installation of the corresponding corrugated sheet metal barrier (i.e. roofing, siding) at a convenient starting point. When the corrugated sheet metal is advanced to the point of encountering a transition vessel (or other protuberance), the position, shape, and size of a transition barrier hole is determined. A predetermined transition barrier hole is then cut through the corresponding corrugated sheet metal barrier 268. Gasket plugs are obtained having a profile complementing the profile of the chosen corrugated sheet metal barrier. Each gasket plug is cut to a predetermined length if necessary and trimmed to provide clearance for the corresponding transition vessel 270. Sealant is applied to each side of the gasket plugs and the entire area targeted for sealing 272. Each gasket plug is positioned 274 for mating with corrugations on the corrugated sheet metal barrier then the corrugated sheet metal barrier is placed over the transition vessel 276. A final adjustment of the gasket plugs and corrugated sheet metal barrier is made 278. The corrugated sheet metal barrier is then secured to the building frame 280.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A method of sealing a transition vessel extending through a corrugated material used for at least one of roofing and siding, the steps comprising:

obtaining at least one of a roof and wall structure;

creating an opening in the at least one of the roof and wall structure operable to pass a transition vessel;

installing a transition vessel in the opening and securing it in place;

obtaining a corrugated material and determining position, shape, and size of a transition barrier hole to be made through the corrugated material sufficient to pass the transition vessel;

cutting the transition barrier hole in the corrugated material;

obtaining one or more elongate gasket plugs having a generally planar ground facing surface and a metal facing surface opposite the ground facing surface and wherein the profile of the metal facing surface generally complements the profile of the corrugated material;

applying sealant to the generally planar ground facing surface and metal facing surface of the one or more elongate gasket plugs;

positioning the one or more elongate gasket plugs to mate with corrugations on the corrugated barrier;

placing the corrugated sheet metal material over the transition vessel; and positioning the one or more gasket plugs assuring a seal around the circumference of the barrier hole.

2. The method of claim 1 wherein the step of installing a transition vessel in the opening and securing it in place further comprises the step of installing a flashing having a flat sealable flange to the transition vessel.

3. The method of claim 1 further comprising the step of beginning installation of corrugated sheet metal on one of the roof and wall and advancing to encounter the transition vessel.

4. The method of claim 1 further comprising the step of validating the transition barrier hole position in the corrugated material by positioning the transition vessel in the transition barrier hole.

5. The method of claim 1 further comprising the step of validating the transition barrier hole position by aligning the transition barrier hole with the transition vessel and positioning the corrugated material on the corresponding roof or wall.

6. The method of claim 1 further comprising the step of securing the corrugated material to at least one of the roof and wall structure.

7. The method of claim 1 further comprising the step of applying sealant between areas of contact between the corrugated material and the corresponding roof or wall.

8. The method of claim 1 further comprising cutting the elongate gasket plug into two or more shorter gasket plugs.

9. A method of sealing a transition vessel extending through a corrugated material used for at least one of roofing and siding, the steps comprising:

obtaining at least one of a roof and wall structure;

creating an opening in the at least one of the roof and wall structure operable to pass a transition vessel;

installing a transition vessel in the opening and securing it in place;

obtaining a corrugated material and determining position, shape, and size of a transition barrier hole to be made through the corrugated material sufficient to pass the transition vessel;

cutting the transition barrier hole in the corrugated material;

obtaining a ribbed gasket having a generally flat lower surface and gasket ribs on an upper surface of the ribbed gasket and whereas the gasket ribs have a profile generally complementary to the profile of the corrugated metal roofing material;

placing the ribbed gasket over the transition barrier hole of the corrugated material with the gasket ribs occupying the corrugations of the corrugated material and using the transition barrier hole as a guide for creating a transition gasket hole;

cutting a transition gasket hole in the ribbed gasket;

placing the ribbed gasket over the transition vessel;

applying sealant to the upper surface of the ribbed gasket encircling the transition gasket hole;

positioning the corrugated material over the ribbed gasket with the transition vessel extending through the transition barrier hole;

aligning the gasket ribs with the corrugations on the corrugated barrier.

10. The method of claim 9 wherein the step of installing a transition vessel in the opening and securing it in place further comprises the step of installing a flashing having a flat sealable flange to the transition vessel.

11. The method of claim 9 further comprising the step of beginning installation of corrugated sheet metal on one of the roof and wall and advancing to encounter the transition vessel.

12. The method of claim 9 further comprising the step of validating the transition barrier hole position and corrugated material by positioning the transition vessel in the transition barrier hole.

13. The method of claim 9 further comprising the step of validating the transition barrier hole position by aligning the transition barrier hole with the transition vessel and positioning the corrugated material on the corresponding roof or wall.

14. The method of claim 9 further comprising the step of securing the corrugated sheet metal to at least one of the roof and wall structure.

15. The method of claim 9 further comprising the step of applying sealant between areas of contact between the corrugated material and the corresponding roof or wall.

16. The method of claim 9 further comprising the step of applying sealant to one or more of the top of flashing and underlayment.

* * * * *